United States Patent [19]

Silverstein et al.

[11] 4,058,097

[45] Nov. 15, 1977

[54] CHOKE CONTROL

[75] Inventors: Allen H. Silverstein, Attleboro; James J. Armstrong, III, Seekonk, both of Mass.

[73] Assignee: Texas Instruments Incorporated, Dallas, Tex.

[21] Appl. No.: 591,548

[22] Filed: June 30, 1975

[51] Int. Cl.[2] ..... F02D 11/08

[52] U.S. Cl. ..... 123/119 F; 261/39 R; 261/39 E; 219/206

[58] Field of Search ..... 261/39 E, 39 R; 123/119 F; 219/206, 207

[56] References Cited

U.S. PATENT DOCUMENTS

| | | | |
|---|---|---|---|
| 2,031,709 | 2/1936 | Hunt | 261/39 E |
| 3,752,133 | 8/1973 | Irish et al. | 123/119 F |
| 3,806,854 | 4/1974 | Armstrong | 123/119 F X |
| 3,907,943 | 9/1975 | Tateno et al. | 123/119 F |

*Primary Examiner*—Wendell E. Burns

*Attorney, Agent, or Firm*—John A. Haug; James P. McAndrews

[57] ABSTRACT

An automotive choke control with improved heating and cooling characteristics to more closely reflect an analogue of the engine temperature for reducing the pollutant content of automotive exhaust gases by regulating the choke. In the control two self-regulating electrical resistance heaters energizable under different conditions supply heat to a thermostat metal coil arranged to move and to open a choke valve as heated. A slotted heat sink plate with a rolled lip is positioned between the heaters and the coil to quickly and uniformly transfer heat to the coil while limiting the heat loss radially outward to the choke housing in which the control is contained. A thermally insulating gasket is also used to further thermally isolate the control from the housing. Additionally a conductive metal top hat is positioned on the opposite side of the coil from the plate to enhance quick, uniform heating and slow cool down.

14 Claims, 7 Drawing Figures

CHOKE CONTROL

BACKGROUND AND SUMMARY OF INVENTION

This invention relates to a new improved choke control and more particularly to an automotive choke control with improved heating and cooling characteristics to more closely reflect an analogue of the engine temperature.

Conventional automotive choke controls have used a thermostat metal coil thermally-coupled to the motor to open a choke valve for permitting more air to enter a carburetor as the motor heats up. In this way the conventional control is to provide a rich air-fuel mixture to the motor when the motor is first started to facilitate motor starting, while supplying a leaner air-fuel mixture for achieving greater fuel economy after the motor has reached its normal operating temperature. These controls, however, are unsatisfactory under certain conditions (i.e. high altitudes) and generally not quick enough in their response.

To improve the control, a self-regulating electrical resistance heater is used to provide quicker response by the coil and thereby minimize operation with the rich air-fuel mixture. The use of the self-regulating heater greatly improved the operation of the control but heat loss from the control to its surrounding housing still remains a problem. The heat loss retards the heat-up response time and increases the rate of cool down, both of which inhibit proper operation of the choke control. Additionally a larger heater is needed to try to overcome these difficulties and the associated costs increases it provides.

Accordingly, it is an object of this invention to provide a novel and improved control for an automotive choke valve; to provide such an improved control with improved heating and cooling characteristics to minimize the quantity of pollutants discharged by an automotive motor to provide such a control which is reliable and which has a long service life; and to provide such a control which is of simple, inexpensive, and rugged construction.

Other objects, advantages and details of the controls for automotive choke valves as provided by this invention appear in the following detailed description of preferred embodiments of the invention, the detailed description referring to the drawings in which.

Figure 1:
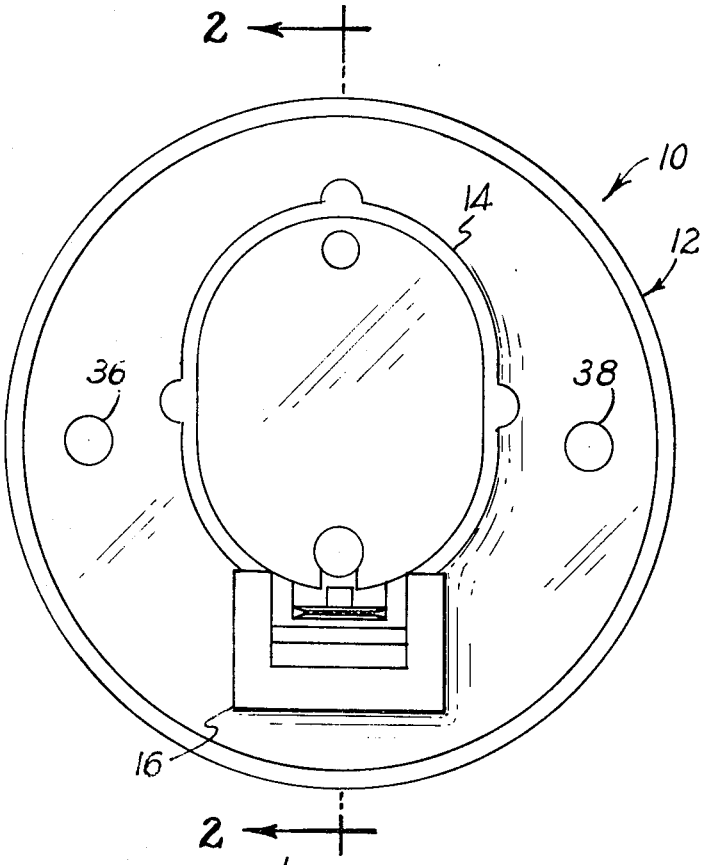
FIG. 1 is a plan elevation view of the improved control device provided by this invention.
Figure 2:
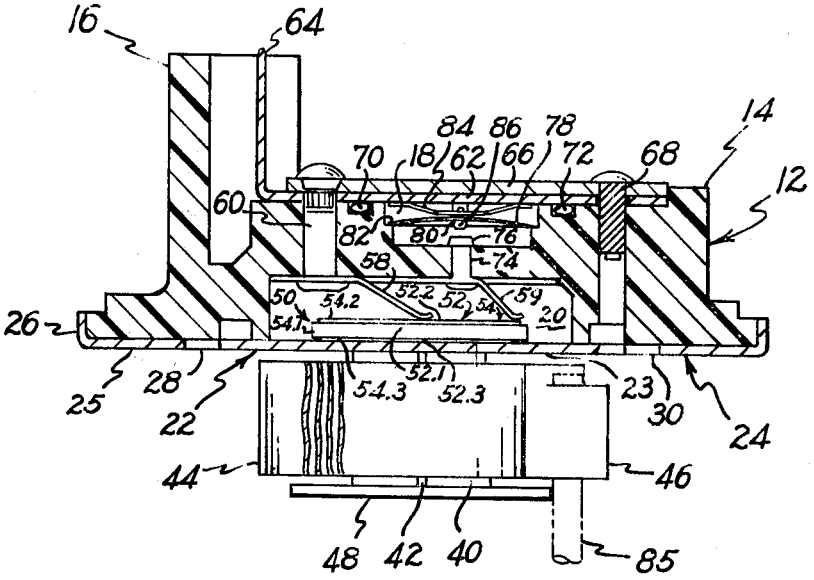
FIG. 2 is a section view along line 2—2 of FIG. 1.

Referring now to the drawings, 10 in FIGS. 1 and 2 indicates the novel and improved control for an automotive choke as provided by this invention. The control 10 includes a housing 12 having a body portion 14 and a tab portion 16. Body portion 14 has an internal cavity 18 and a lower recess portion 20. The housing 12 is preferably formed of a strong rigid dielectric material such as a phenolic resin or the like.

Figure 3:
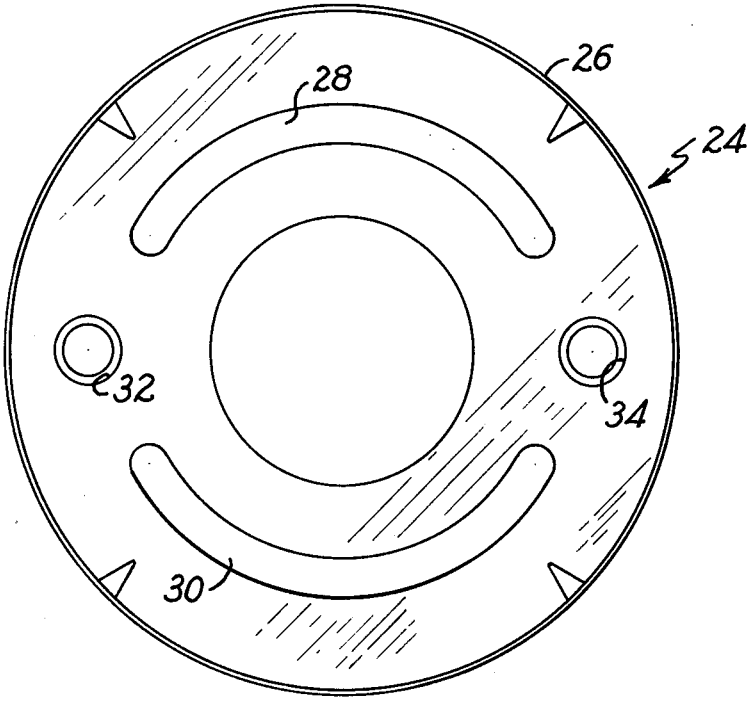
FIG. 3 is a plan view to enlarged scale of the heat sink plate component used in the control of FIG. 2.

In accordance with this invention, the choke control 10 incorporates a heat sink member 22 having generally round plate 24 with a heater portion 23 and a mounting portion 25. Plate 24 closes off recess portion 20. As best shown by FIG. 3 plate 24 has rolled edge 26 which extends around the bottom of housing 12. Plate 24 also has two semi-circular slots 28, 30 as shown by FIG. 3 positioned between heater portion 23 and mounting portion 25 for preventing radial heat loss which will be discussed more fully below. Positioned between, and preferably slightly radially outward from the respective ends of the slots are two apertures 32, 34 in mounting portion 25 for receiving rivets 36, 38 which secures plate 24 to housing 12. As shown particularly in FIG. 2 heat sink member 22 has a bushing portion 40 which may comprise a separate element secured as by staking or welding to the remainder of the heat sink member of which may be formed as an integral part of the heat sink member. Preferably the heat sink member is formed of a metal of high thermal conductivity and typically the heat sink member is formed of cold rolled steel having the bushing 40 formed of brass.

In the choke control, slots 42 are formed on heat sink bushing 40 and one end of a thermostat metal coil 44 is fitted snuggly into one of the slots, the thermostat metal coil being spirally wound from composite, multilayer thermostat metal strip and being provided at its opposite end with a tang 46 which extends radially outward from the coil. Preferably, the coil is made from a two or a three layer material having one of the layers of relatively high coefficient of thermal expansion and another of the layers of relatively low coefficient of thermal expansion. The fitting of the coil end into the bushing slot securely attaches the thermostat metal coil to the heat sink member and holds the coil end in fixed position. In this arrangement the spiral coil unwinds and moves the coil tang 46 (clockwise relative to the control as viewed in FIG. 1) as the thermostat metal coil is heated.

Figure 7:
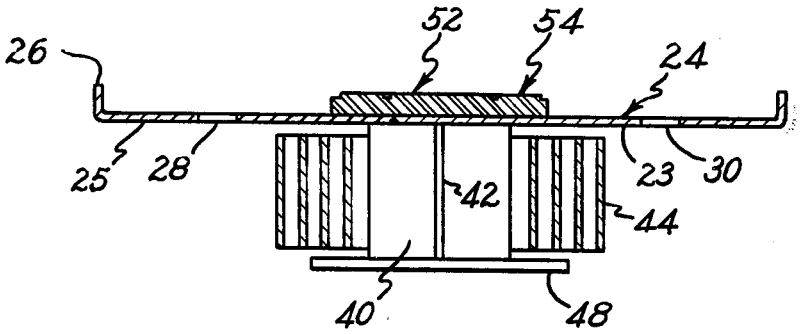
FIG. 7 is a section view of the heater means, heat sink member, and thermostat coil of FIG. 2.

In accordance with this invention, a flange or top hat member 48 is secured as by staking, welding, or riveting to the bottom of bushing 40 as best shown by FIGS. 2 and 7 to be part of heat sink means 22. Flange member 48 extends along a substantial portion of one lateral edge of coil 44 and plate 24 extends along the other lateral surface of the coil. Preferably member 48 is made of a rigid metal of high thermal conductivity to protect the coil from damage and to provide improved heating and cooling properties for control 10 which will be fully discussed below.

A self-regulated electrical resistance heater means 50 is secured to heat sink member 22 within housing recess 20 so that the heater means is thermally coupled to the thermostat metal coil 44 through the heat sink member. Preferably heater means 50 comprises two resistance heaters 52, 54 as shown in FIG. 2 with body portions 52.1 and 54.1 of resistive material having opposite metal surface layer 52.2, 52.3 and 54.2, 54.3 secured thereto to serve as electrical contacts for the heaters. The heater contact layers 52.3 and 54.3 are preferably secured to the heat sink member by use of a metal-filled, electrically-conductive epoxy adhesive or the like or may be soldered to the heat sink if desired.

Preferably, for example, heater bodies 52.1 and 54.1 are formed of a material which has a positive temperature coefficient of resistance and which is adapted to display very low resistance as electrical current is directed through the resistive material at room temperature but which is adapted to be self-heated within a very brief period of time to an anomaly temperature at which the resistance of the heater material very sharply increases.

Figure 4:
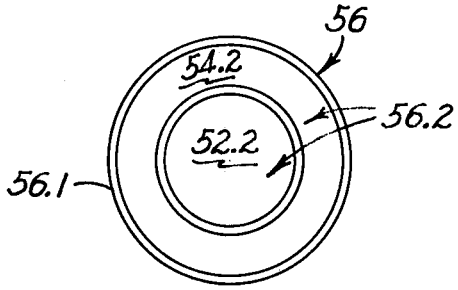
FIG. 4 is a plan view to an enlarged scale of the heater element used in the control of FIG. 2.

Preferably, for example, heaters 52 and 54 are contained in a single heater element 56 as shown by FIG. 4 for greater economy of manufacture. Heater element 56 is typically formed of lanthanum-doped barium titanate having the empirical formular $Ba_{0.997}$ $La_{0.003}$ $TiO_3$. A metal surface 56.2 is preferably selectively silk screened on a heater body portion 56.1 yielding a contact surface with two contacting portions as shown by FIG. 4 which correspond to surfaces 52.2 and 54.2 of heaters 52 and 54. An alternate method would be to scribe or otherwise machine contacting surface 56.2 dividing it into two portions. Electrical resistance heaters of this type are self-regulating in that, as the heaters reach their anomaly temperature and display sharply increased resistance, current in the heaters is reduced so that the heater temperature is stablilized at about the anomaly temperature, subsequent current in the resistors serving to maintain the heaters at this temperature. As will be understood, self-regulating heaters of the type described are relatively insensitive to voltage variations from 6 to 16 volts (D.C.) and can withstand voltage surges ten times greater than normal voltage levels. These heater materials are therefore well suited for use in automotive electrical systems.

In accordance with this invention, these self-regulating heaters 52 and 54 are each arranged to heat the same heat sink member 22 but are adapted to be energized under different conditions. Thus two spring contact members 58 and 59 of electrically conductive metal material are secured to the housing 12 within recess 20 for making contact with heater 52 and 54 respectively. Contact member 58 is secured by a rivit 60 which extends through the housing to engage and electrically be in connection with an electrical contact plate 62 having a terminal portion 64 as shown by FIG. 2. The terminal portion is engaged by a connector (not shown) which is connected to the electric power source for the automobile. In addition rivet 60 holds an insulator plate 66 in position along with a rivet member 68. An O-ring gasket 70 is inserted in a notched out portion 72 of housing 12 prior to securing the rivets to provide effective sealing of the cavity against environmental moisture.

Second contact member 59 is secured within recess 20 by an electrically conductive metal rivet 74, one end 76 of the rivet extending into the housing cavity to serve as an electrical contact. A snap-acting thermostat metal disc 78 having an opening 80 therein is also placed in the housing cavity with its disc perimeter resting on a housing shoulder 82 in the cavity. An additional spring contact member 84 such as of a spider-like configuration is provided with an electrical contact 86 secured at the center of the spider and is arranged in the housing cavity 18 on top of the thermostatic disc 78 with spider contact 86 fitted into the disc opening 80 as shown by FIG. 2. The electrical contact plate 62 along with insulator 66 cover housing cavity 18 retaining thermostat disc 78 and spider spring contact 84 within the housing. The thermostatic disc 78 is formed of a selected bimetallic material and is provided with a selected dished configuration in conventional manner so that, at a selected ambient temperature, below 60° F., for example, the disc is disposed as shown in FIG. 2 to hold the spider contact out of engagement with rivet contact 86 but so that, at ambient temperature above 60° F., the disc 78 moves with snap action to the inverted dished configuration to engage the spider contact 86 with rivet contact 74 and thereby complete electrical path from the contact plate to heater 54. Thus, thermostat disc 62 functions as an ambient temperature sensing switch in choke control 10 of this invention. If the motor is started under ambient temperature conditions at or above 60° F., disc 78 will be positioned to cause energization of heater 54 as the motor is started. Under these ambient temperature conditions, heaters 52 and 54 cooperate to heat heat sink member 22 more quickly than when only heater 52 has been energized. As a result, thermostat metal coil 44 is very quickly heated to the temperature necessary to move tang 46 which in turn moves a bell-crank 85 as shown in FIG. 2 fully opening the carburetor choke valve after motor starting to minimize pollution emission from the motor.

Figure 5:
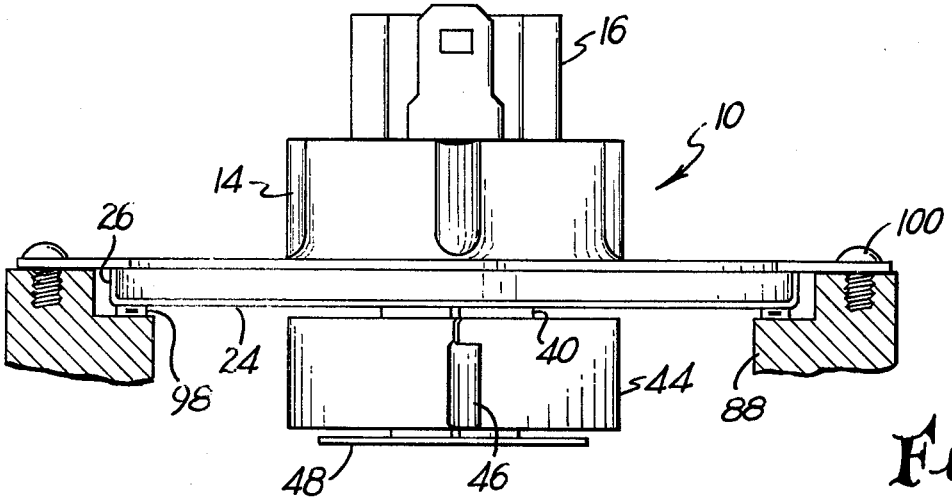
FIG. 5 is a partial section view of the control device of this invention in the choke housing of an automobile.
Figure 6:
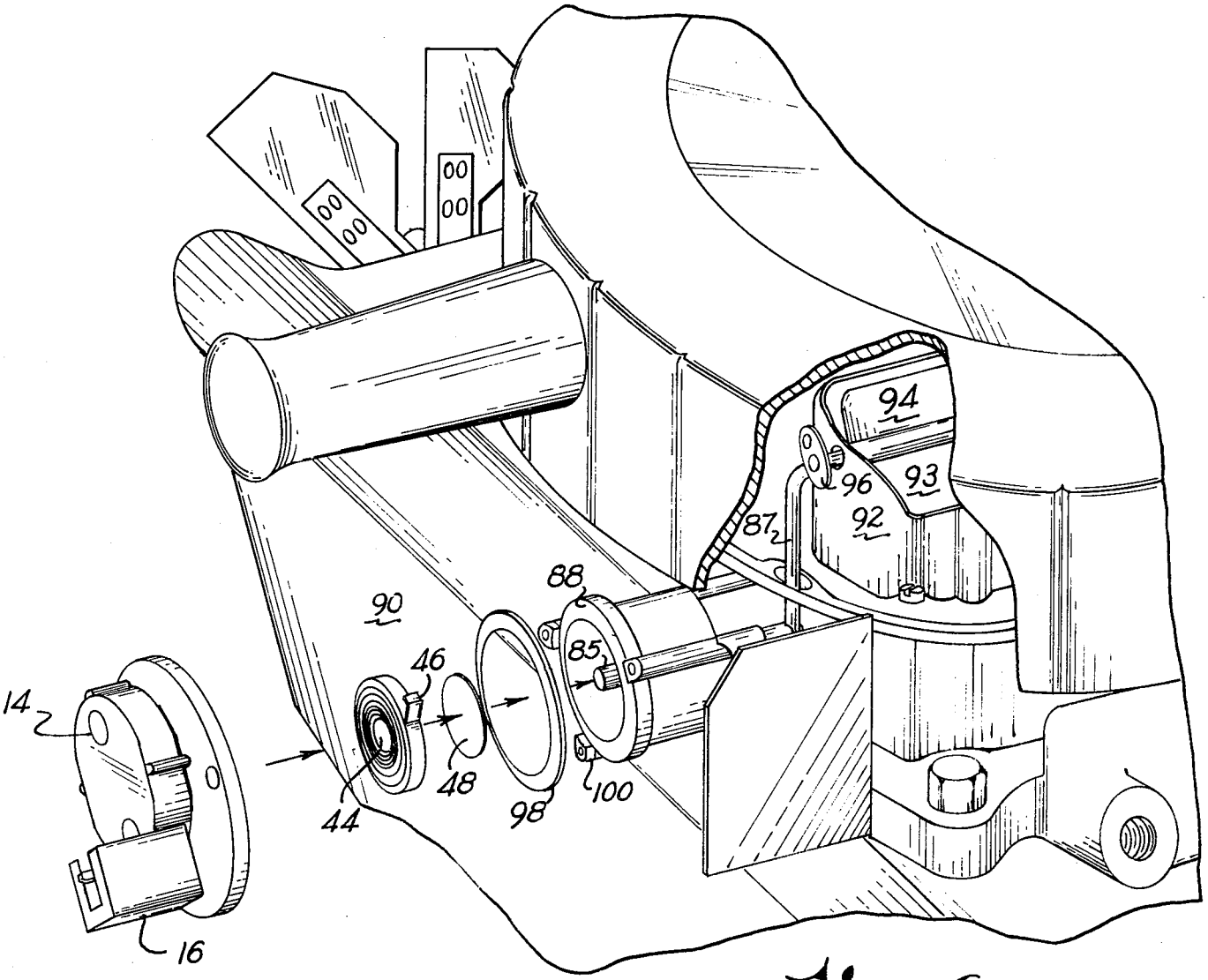
FIG. 6 is a fragmentary partially exploded perspective view partially cut-away of a portion of a conventional internal combustion engine and carburetor provided with a control device in accordance with the present invention.

Typically, choke control 10 is housed in a metal choke housing 88 as shown by FIGS. 5 and 6 preferably mounted on an engine 90. A thermally insulating gasket 98 is positioned between metal plate 24 and choke housing 88 to thermally isolate control 10 from the housing. Rolled edge 26 makes electrical connection to ground to complete the electrical circuit by contacting hold down ears 100 of the housing. The housing 88 is adjacent a carburetor 92 containing a choke valve 94 preferably of the butterfly type for controlling the ratio of air to fuel in the fuel air mixture being delivered by the carburetor 92 through a passage 93 to engine 90. It may be seen that movement of tang 46 of thermostat coil 44 in response to temperature changes effects rotation of bell crank member 85 and linkage member 87 and hence effects pivotal movement of the pivotally mounted plate 96.

Accordingly, upon starting the car when the ambient temperature is below the snap temperature of disc 80, only heater 52 is energized to heat the coil. However, if the ambient temperature is above the snap temperature both heaters 52 and 54 are energized to provide heat to the coil. This heat from the heaters is carried to the coil by heat sink means 22. It is important for quick response by the coil that there by uniform heating of all parts of the coil at the same time. The importance of uniform heating is particularly true when conventional two layer bimetal coils are used which have relatively poor thermal conductivity properties. The use of slotted plate 24, bushing 40, and top hat member 48 of this invention provide for uniform consistent heating. Heating is supplied to the coil centrally from the bushing and from the top and from the bottom respectively from plate 24 and top hat 48 to provide improved heat-up time. Additionally the effect of coning in the coils on the heating characteristics of the control are minimized with heating from both top and bottom. The average distance of any part of the coil from a heat source is much more uniform. This factor allows for far greater consistency of operation from control to control.

The semi-circular slots 28 and 30 in plate 24 break up the heat flow path outward to the conductive choke housing 88. The slots are positioned between heater portion 23 and mounting portion 25 so that the body of coil 44 is contained within the slots. Thus, heat is preserved in the inner heater plate portion 23 to maximize the use of the heat generated by heaters 52 and 54 to heat the coil. It is important to maximize the use of the heat present to provide quicker choke response time. Additionally, it allows for the use of smaller less expensive heaters under certain conditions. Also it is important upon deenergization of the heaters that the heat is not lost quickly. Ideally, control 10 should cool down at the same rate as the engine so the choke is in the proper position upon restarting of the motor again. The slots tend to prevent quick cool down of the control by preventing the heat from being drawn radially outward to the conductive choke housing.

Top hat member 48 is also useful to prevent rapid cool down of the control in addition to providing for more uniform, quicker heating. Member 48 shields the coil from any convection currents that could be set up in the choke housing to cool the coil and also retards cool off because of the presence of its thermal mass.

The use of thermally insulating gasket 90 to thermally isolate control 10 from the choke housing is also helpful to provide quick response time and slow cool down. The use of the rolled lip still provides for electrical connection to be made with the housing while minimizing the heat transfer loss to it.

It should be understood that although particular embodiments of the choke control of this invention have been described in detail by way of illustrating this invention, this invention includes all modifications and equivalents of the disclosed embodiments falling within the scope of the appended claims.

We claim:

1. Control means having an ambient temperature compensating feature for adjusting a choke in an automotive motor system as motor temperature increases after initiation of motor operation comprising heat response means movable in response to increase in temperature of said heat responsive means for adjusting the choke, heat sink means surrounding heat responsive means on three sides for providing uniform, quick heat transfer to said heat responsive means, said heat sink means comprising a bushing to which said heat response means is secured, a plate having heater portion and a mounting portion mounting said bushing and having one surface extending along one lateral edge of said coil and another surface on which said electrical heater means is mounted, and a flange member mounted on said bushing and having one surface extending along another lateral edge of said coil, self-regulating electrical resistance heater means mounted on said heat sink means and energizable from an electrical power source upon initiation of said motor operation for heating said heat responsive means, additional self-regulating electrical resistance heater means mounted on said heat sink means for supplementing heating of said heat responsive means when said additional heater means is energized, and thermostatic switch means connectable to an electrical power source upon initiation of said motor operation and actuable above a selected ambient temperature for energizing said additional heater means.

2. Control means as set forth in claim 1 wherein said heat-responsive means is a spirally wound thermostat coil.

3. Control means as set forth in claim 2 further providing for slots in said plate positioned between said heater portion and said mounting portion of said plate.

4. Control means as set forth in claim 3 wherein each of said electrical heater means comprises an electrical resistance heater element of a self-regulating type which has a positive temperature coefficient of resistance and which is adapted to self-heat when electrically energized to reach a selected temperature at which the resistance of the heater element sharply increases for stabilizing the temperature of the heater element at a selected level.

5. Control means having an ambient temperature compensation feature for adjusting a choke in an automotive motor system as motor temperature increases after initiation of motor operation comprising a housing of dielectric material with recess, a heat sink member of thermally and electrically conductive metal material having a heat sink plate with a heater portion and a mounting portion for mounting said member over said housing recess, and a bushing portion extending from said heater plate portion, a flange heat sink member of thermally conductive material mounted on said bushing portion opposite said heater plate portion, a thermostat metal coil secured at one end to said heat sink bushing portion and extending around said bushing portion along one surface of said heat sink plate and one surface of said flange member, said coil being movable in response to increase and decrease in coil temperature for adjusting said choke, self-regulating electrical resistance heater means having one end mounted on an opposite surface of said plate portion within said housing recess in electrically conductive relation to said heat sink member and in heat-transfer relation to said coil, electrical contact means engaging an opposite end of said heater means for energizing said heater from an electrical power source upon initiation of said motor operation for heating said coil, additional self-regulating electrical resistance heater means having one end mounted on said opposite surface of said plate within said housing recess in electrically conductive relation to said heat sink member and in heat-transfer relation to said coil, and thermostatic switch means engaging an opposite end of said additional heater means, said switch means being connectable to an electrical power source upon initiation of said motor operation and being actuable above a selected ambient temperature for energizing said additional heater means.

6. Control means as set forth in claim 5 further providing for slots in said plate positioned between said heater portion and said mounting portion of said plate.

7. Control means as set forth in claim 6 wherein each of said electrical heaters comprises a body of resistive material which has a positive temperature coefficient of resistance and which is adapted to self-heat when electrically energized to reach a selected temperature at which resistance of said material sharply increases for stabilizing heater temperature at a selected level, said body of resistive material having a layer of metal secured to each of two opposite sides thereof forming electrical contacts for said heater.

8. Control means as set forth in claim 7 wherein said resistive material comprises lanthanum-doped barium titanate.

9. A carburetor for an internal combustion engine comprising an air and fuel induction passage, a choke valve for controlling the ratio of air to fuel in said passage, control means for setting the position of said choke valve in said passage, and a choke housing mounted on said engine containing said control, said control provided with resistance heater means, a heat sink means with a rolled lip and a gasket member mounted adjacent said lip for providing heat to a heat responsive means in said control while minimizing heat loss to said choke housing.

10. A carburetor as set forth in claim 9 wherein said heat responsive means is a spirally wound thermostat coil.

11. A carburetor as set forth in claim 10 wherein said heat sink means further comprises a bushing in which one end of said thermostat coil is secured, a plate having a heater portion and a mounting portion mounting said bushing and having one surface extending along one lateral edge of said coil and another surface on which said electrical heater means is mounted, and a flange member mounting said bushing and having one surface extending along another lateral edge of said coil.

12. A carburetor as set forth in claim 11 further providing for slots in said plate positioned between said heater portion and said mounting portion of said plate.

13. Control means as set forth in claim 12 wherein said resistant heater means comprises a self-regulating electrical resistance heater and an additional self-regulating electrical resistance heater each of said self-regulating electrical resistance heaters being of a positive temperature coefficient of resistance type which is adapted to self-heat when electrically energized to reach a selected temperature at which the resistance of the heater element sharply increases for stabilizing the temperature of the heater at a selected level.

14. Control means having an ambient temperature compensating feature for adjusting a choke in an automotive motor system as motor temperature increases after initiation of motor operation comprising heat response means movable in response to increase in temperatures of said heat responsive means for adjusting the choke, heat sink means surrounding heat responsive means on three sides for providing uniform, quick heat transfer to said heat responsive means, said heat sink means comprising a bushing to which said heat response means is secured, a plate having heater portion and a mounting portion mounting said bushing and having one surface extending along one lateral edge of said coil and another surface on which said electrical heater means is mounted, and a flange member mounted on said bushing and having one surface extending along another lateral edge of said coil, and self-regulating electrical resistance means mounted on said heat sink means and energizable from an electrical power source upon initiation of said motor operation for heating said heat responsive means.

* * * * *